US005819679A

United States Patent [19]

Bonate et al.

[11] Patent Number: 5,819,679

[45] Date of Patent: Oct. 13, 1998

[54] INTEGRAL BOAT TETHERING DEVICE

[76] Inventors: Douglas J. Bonate; Shelley L. Bonate, both of 2334 NW. 187th Ave., Pembroke Pines, Fla. 33029

[21] Appl. No.: 53,539

[22] Filed: Apr. 1, 1998

[51] Int. Cl.[6] ..... B63B 21/00

[52] U.S. Cl. ..... 114/230

[58] Field of Search ..... 114/218, 219, 114/253, 254, 230, 293, 294, 245; 441/3–5

[56] References Cited

U.S. PATENT DOCUMENTS 3,300,187 1/1967 Saxe et al. .
3,842,780 10/1974 Allens et al. ..... 114/230
4,036,476 7/1977 Douce .
4,200,052 4/1980 Cunningham .
4,697,537 10/1987 Smith .
4,706,594 11/1987 Burns .
4,846,090 7/1989 Palmquist .
5,365,872 11/1994 Obrinski ..... 114/230
5,634,421 6/1997 Velarde .

*Primary Examiner*—Stephen Avila
*Attorney, Agent, or Firm*—McHale & Slavin, P.A.

[57] ABSTRACT

This instant invention is a spring-loaded boat tethering device. More particularly, it discloses an improved spring-loaded boat tethering device which provides reliable and repeatable extension and retraction of mooring lines, secure attachment to a vessel, and positive locking of the mooring line so as to provide fixed positioning of the vessel relative to another object such as a dock, a pier, or another vessel.

11 Claims, 4 Drawing Sheets

INTEGRAL BOAT TETHERING DEVICE

FIELD OF THE INVENTION

This invention relates to spring-loaded boat tethering devices. More particularly, it relates to an improved spring-loaded boat tethering device which provides reliable and repeatable extension and retraction of mooring lines, secure attachment to a vessel, and positive locking of the mooring line so as to provide fixed positioning of the vessel relative to another object such as a dock, a pier, or another vessel.

BACKGROUND OF THE INVENTION

The safe mooring of vessels to docks, piers or other vessels requires that the vessel or dock be equipped with sufficient lengths of tethering material, e.g. mooring rope or cable to enable the vessel to be secured and maintained out of harm's way under a variety of mooring conditions. The tethering material must be easily adjustable in length so as to satisfy a wide variety of mooring conditions. Furthermore, the tether must be easily stowed in a safe and orderly fashion so that it does not become a hazard to passengers or other equipment. A mechanism which can be affixed to a vessel or the adjacent mooring structure, and is capable of reliably and repeatably extending and retracting tethering lines while simultaneously providing positive locking of the tether would be highly desirable.

Various prior art devices have endeavored to provide such mechanisms. For example:

U.S. Pat. No. 4,846,090 discloses an automated boat mooring device. The device may be attached to the gunwale of a boat to dispense and retract mooring line. This device includes a length of rope coiled around a winding spool. The device includes a spring which becomes loaded as line is extended off the spool. In this way, the device automatically will retract line that has been extended for use. A locking-pin-and-pawl assembly selectively stops retracting motion of the spring-loaded spool.

U.S. Pat. No. 4,697,537 discloses a retractable line storage device designed for integral mounting within a boat. The device includes a hollow housing and a spring-loaded storage reel. A mooring line attached to the reel includes a specially shaped handle at a free end of the line. The handle is shaped to fit flush within a deck-mounted top plate.

U.S. Pat. No. 3,300,187 discloses a semi-automatic warping and mooring arrangement. This device teaches a motor-driven rotating spool and pulley assembly that eases docking of large ships.

U.S. Pat. No. 4,200,052 discloses a system for controlling the position of a moored floating vessel. The device is directed at maintaining a boat in a desired position. This device is not aimed at retracting line onto a boat.

U.S. Pat. No. 4,706,594 discloses a boat mooring line guide and holder designed to catch a thrown end of a mooring line during boat docking. This device, which includes a pair of Y-shaped arms mounted on a dock, is designed to engage the ball-shaped end of a modified mooring line. This device does not address the automatic winding features provided by the instant invention.

U.S. Pat. No. 5,634,421 discloses a watercraft mooring apparatus formed from a tubular element having fender elements at either end. Although this device includes a mooring line, no automatic winding features are discussed.

U.S. Pat. No. 4,036,476 discloses an automatic take-up winch used for taking up slack in chains or other flexible securing members. This device does not teach the spring-loaded take-up spool included in the instant invention.

Many of the prior art devices suffer from inherent design deficiencies which quickly render them wholly or partly inoperative when subjected to the constant rigors of a corrosive marine environment. For example, the spring mechanism of the Palmquist device (the '090 patent) suffers due to the fact that it turns upon itself while line is paid out. This causes friction and binding which results in erratic operation and premature failure of the spring motor. The Smith device (the '537 patent) does not provide for positive locking of the tether. Smith requires that an appropriate length of tether be first made fast to the boat's cleat and then to the appurtenant docking structure. This causes difficulty in accurately positioning the vessel because any adjustments would require that the tether be unfastened from the cleat when it is under tension from the vessel. This is an unsafe and dangerous practice at best.

It is therefore an object of the present invention to provide an improved spring-loaded boat tethering device which is able to provide reliable and repeatable extension and retraction of tethering lines and secure attachment of said lines to a vessel and/or structures appurtenant thereto.

It is a further object of the invention to provide positive spool locking means by which the spool to which the tethering lines are attached may be fixed so as to prevent unwanted slippage.

It is an additional object of the present invention to provide an improved preloaded spring motor which acts to provide uniform and relatively constant tension to the tethering line during the full extent of its travel while avoiding the friction related spring failure known to occur in the prior art devices.

It is also an important object of the present invention to provide a device wherein the tethering line may be in the form of a rope or cable, e.g. a vinyl-coated steel cable, which can be used for anchoring situations in addition to mooring of said vessel.

It is yet another object of the present invention to provide a device wherein the components are formed from materials which are corrosion resistant and designed to withstand the rigors of a marine environment.

Still another object of the present invention is to provide a device which can be mounted in place of a standard boat cleat and wherein the attachment means are rendered tamper resistant upon assembly.

Other objects and advantages of the present invention will become apparent to those skilled in the art from the following detailed description when read in conjunction with the accompanying drawings.

SUMMARY OF THE INVENTION

The present invention relates to a boat tethering device formed from corrosion resistant materials throughout and containing an extensible tethering means which is adapted to extend or retract from a housing. The housing is formed from two attachable pieces, a lower half and an upper half. The lower half is formed with integral mounting apertures suitable for facilitating the attachment of the housing to a boat or a dock while the upper half is formed so as to sealably engage the lower half. The assembled housing will contain a spool assembly which is characterized by a hollow and generally-cylindrical portion having a first end and a second end and being rotatably mounted within the housing. The generally-cylindrical portion has an outer region which provides an external tether supporting surface and an inner region which is delineated by an inner conical zone formed with spaced ribs along the circumference thereof. The diameter of the inner conical zone decreases in an axial direction from said first end to said second end. The spool assembly is further characterized by first and second opposed guidewalls which extend perpendicularly to the axis of said assembly and are positioned at each of said first and second ends respectively. The first guidewall is further adapted to receive a spool locking means; and the second guidewall is adapted to engage the spring biasing means. Lastly, the guidewalls are further characterized by bearing surfaces extending axially therefrom and are adapted to facilitate ease of rotation of the assembly within said housing. The device contains a spool locking means which has a cylindrical member adapted to frictionally engage the inner conical zone of said spool assembly and having corresponding ribs spaced along the outer circumference of said member. Upon insertion within said zone, the corresponding ribs interlock with the ribs of said zone thereby preventing rotation. Spring biasing means are preferably formed from an extended eye spring assembly adapted to provide relatively constant tension upon said tethering means. In operation, the tethering means can be simply extended and retracted from the housing and reliably locked in any position.

DETAILED DESCRIPTION OF THE PREFERRED EMBODIMENT

Figure 1:
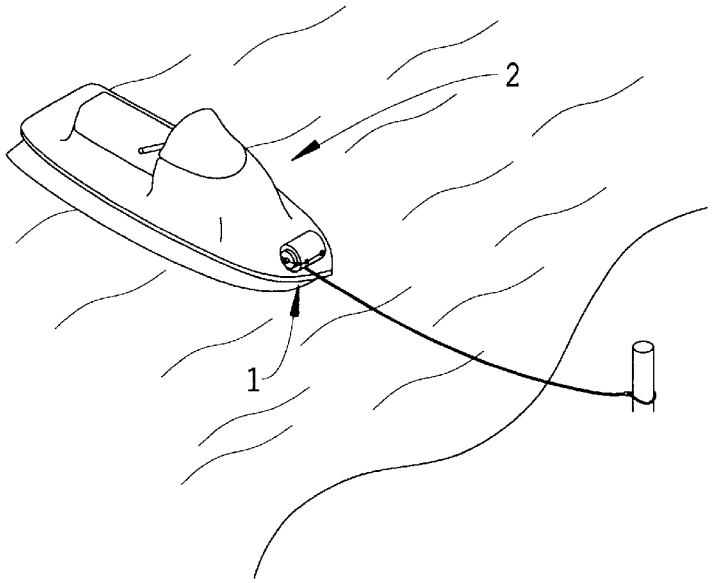
FIG. 1 is a pictorial view of the boat tethering device in accordance with the present invention showing the device attached to a personal watercraft.
Figure 2:
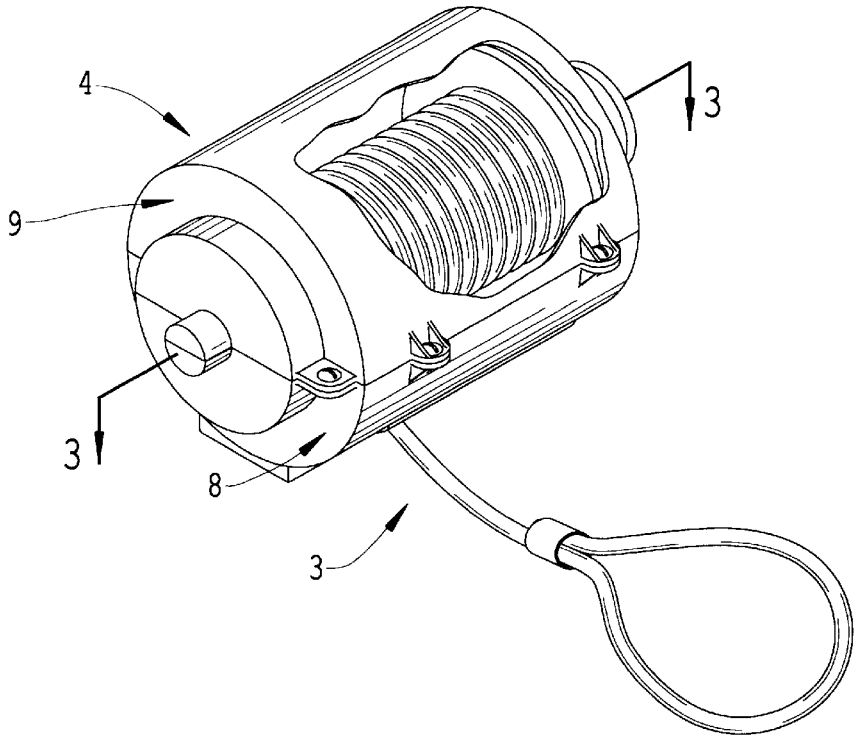
FIG. 2 is a perspective view of the device with a cut-away to better illustrate the cooperation of the internal portions and the outer casing.
Figure 3:
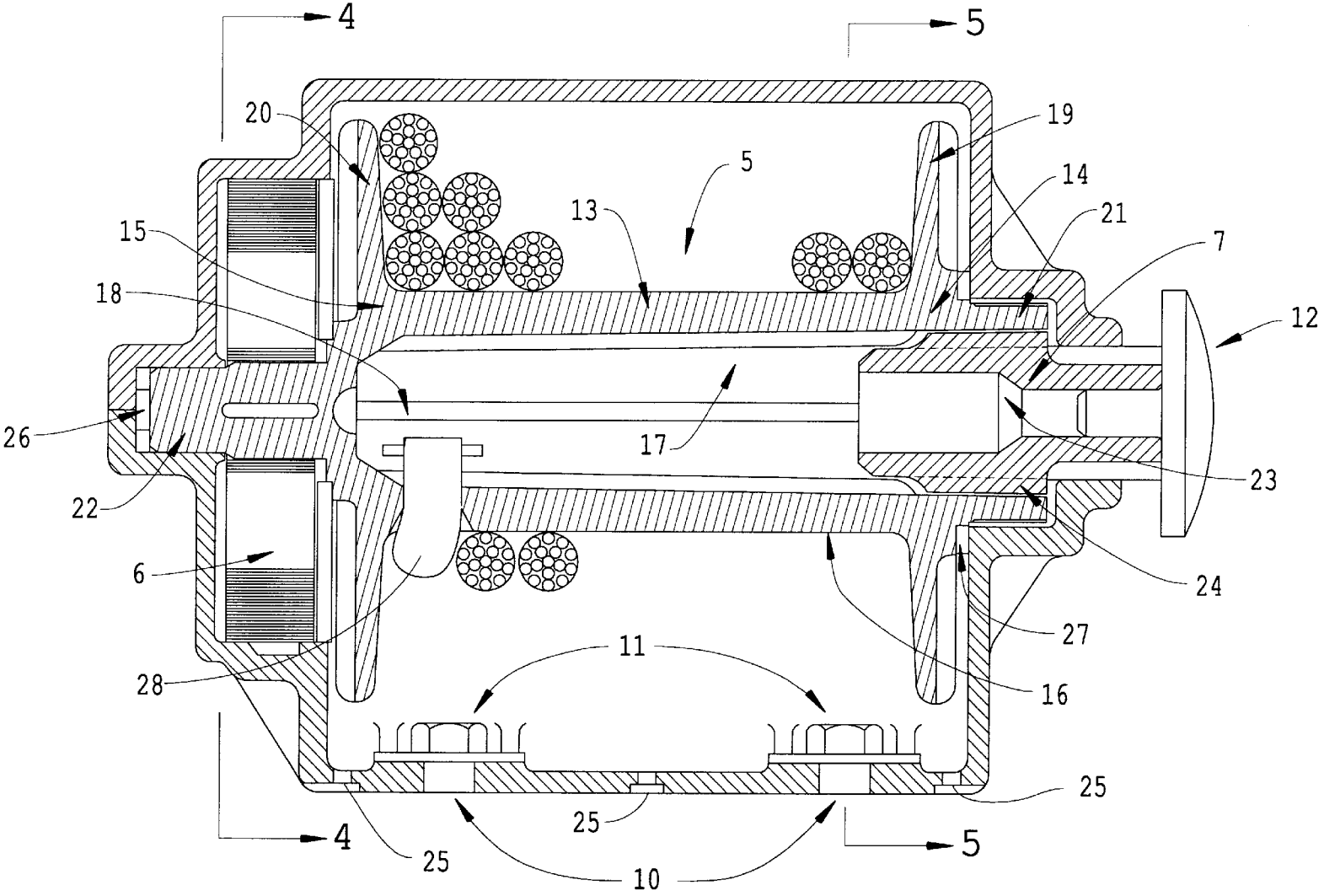
FIG. 3 is cross-sectional view of the device taken along line 3—3 of FIG. 2.
Figure 4:
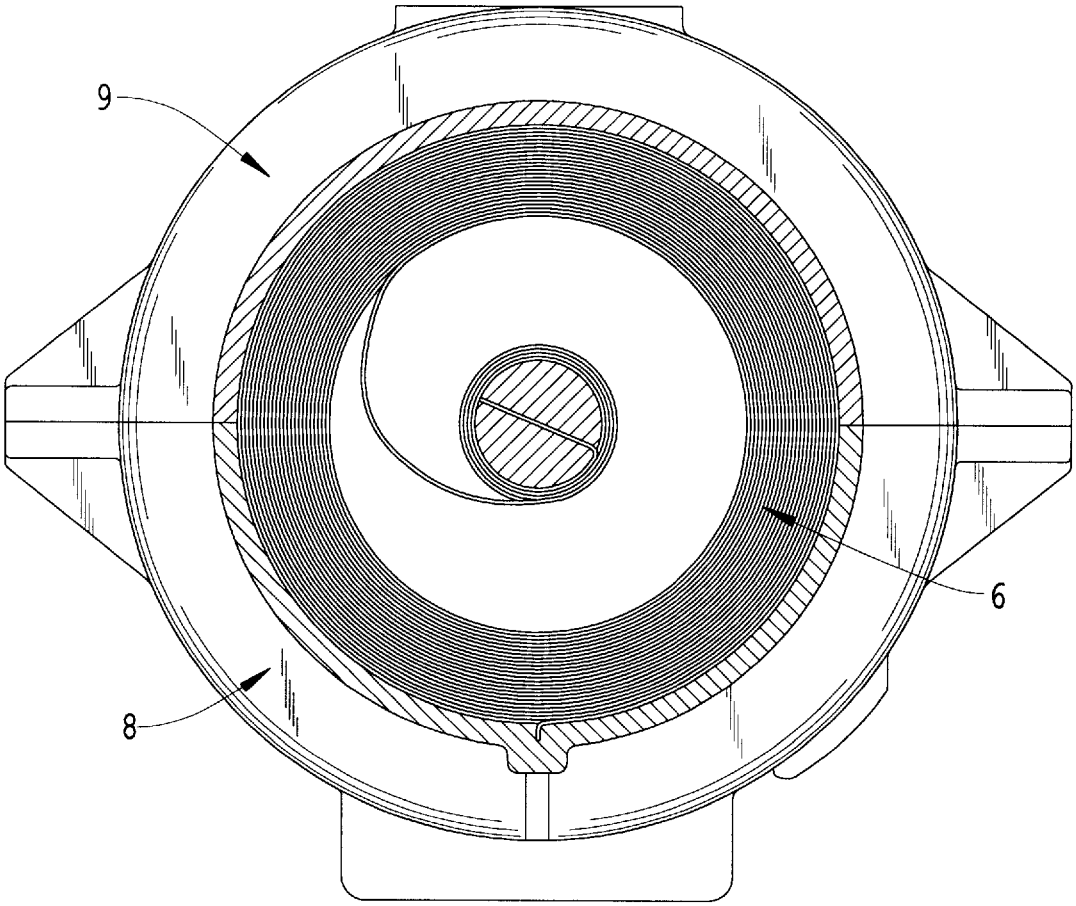
FIG. 4 is a cross-sectional view of the device detailing the spring-biasing apparatus taken along line 4—4 of FIG. 3.
Figure 5:
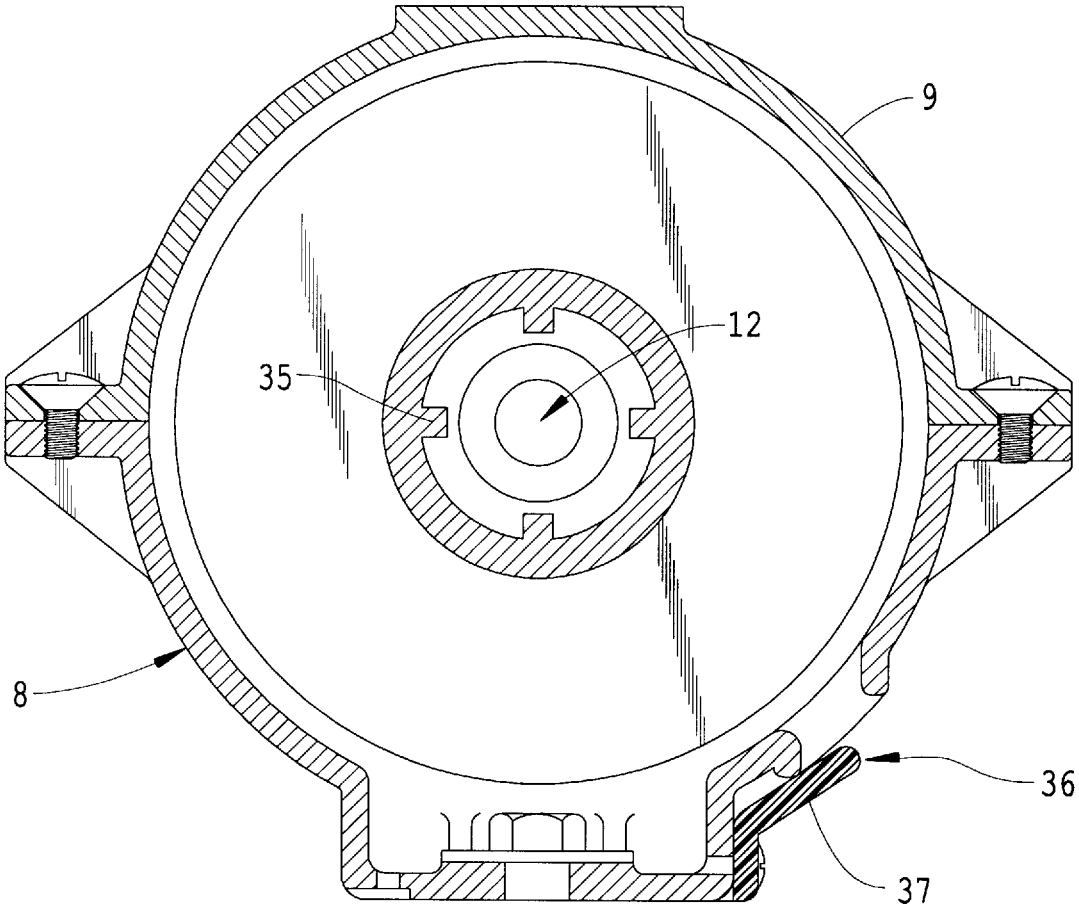
FIG. 5 is a cross-sectional view of the device detailing the cooperation of the spool assembly and locking device taken along line 5—5 of FIG. 3.

Referring to the drawings, FIG. 1 shows an enlarged boat tethering device 1 in accordance with the present invention mounted to a personal watercraft 2. The device, as seen in FIGS. 2 and 3, broadly includes a tethering means 3, a housing 4, a spool assembly 5, a spring biasing means 6 and a locking means 7. The extensible tethering means 3 can be a rope or cable, and in a particularly preferred embodiment can be a vinyl-coated steel cable. In operation, the tethering means, which is anchored to the spool through aperture 28 in Fig.3, travels through a slot (36 in FIG. 5) in the lower half of the housing, and in a particularly preferred embodiment, a thermoplastic rubber wiper (37 in FIG. 5) may be included to add tension and aid the winding pattern. The housing 4 has a lower half 8 and an upper half 9. The lower half is formed with integral mounting apertures, generally described by numeral 10 suitable for facilitating attachment to a boat or a dock, with, for example, mounting bolts 11, as depicted in FIG. 3. The upper half sealably engages the lower half and is adapted to contain a spool assembly 5. The spool assembly is characterized by a hollow and generally-cylindrical portion 13 having a first end 14 and a second end 15 and being rotatably mounted within the housing. The generally-cylindrical portion has an outer region which provides an external tether supporting surface 16 and an inner region which is delineated by an inner conical zone 17 formed with spaced ribs or splines 18 along the circumference thereof. The diameter of said zone decreases in an axial direction from the first end to the second end. The spool assembly is further characterized by first and second opposed guidewalls which extending perpendicularly to the axis of the spool assembly and are positioned at each of said first and second ends respectively. The first guidewall 19 is adapted to receive a spool locking means 7; and said second guidewall 20 is adapted to engage spring biasing means 6. The guidewalls are further characterized by bearing surfaces 21 and 22 extending axially therefrom and are adapted to facilitate ease of rotation of said assembly within said housing. In the particularly preferred embodiment, as shown, thrust bearings 26 and 27 are included, which aid in maintaining the positioning of the spool assembly during the operation thereof. The spool locking means has a cylindrical member 23 adapted to frictionally engage the inner conical zone of said spool assembly and additionally has corresponding ribs or splines 24 spaced along the outer circumference of said member. Upon depressing the actuator knob 12 which causes insertion of the spool locking means into the housing and into frictional engagement with the inner conical zone of the spool assembly, the corresponding ribs or splines of the locking means interlock with both the integral grooves (35 in FIG. 5) in the housing and with the ribs or splines of said zone thereby preventing rotation. The spring biasing means 6, as best seen in FIG. 4 comprises an extended eye spring assembly. This spring assembly is a major advance over conventional backwound springs because it actually increases available torque with fewer initial turns or prewinds. In the extended eye design, prewinds are formed by alternating layers of the eye and spring element. In a particularly preferred embodiment, a 28 turn spring is utilized with 4 turns thereof devoted to the prewind. This results in a more economical spring design and improved performance due to the torque increase in the initial few turns producing a flatter torque curve over the entire working range of the spring. Thus, a relatively constant tension is applied to the tethering means while it is being extended and retracted from said housing which results in reliable and efficient operation. To allow for drainage of water, which is carried within the device by the tethering means, weep holes 25 are provided for drainage. Furthermore, it is contemplated to provide grease fittings (not shown) in the ends of the housing so as to enable grease or some equivalent lubricant to be inserted between the bearing surfaces of the spool assembly and the housing.

Those skilled in the art will appreciate that numerous variations of the specific embodiments set forth above may be practiced without departing from the spirit of the invention, as claimed below.

What is claimed is:

1. A boat tethering device comprising:

tethering means;

a housing having a lower half and an upper half and being adapted to contain a spool assembly;

the spool assembly characterized by a first end and a second end and being rotatably mounted within the housing;

said assembly being further characterized by first and second opposed guidewalls extending perpendicularly to the axis of said assembly and positioned at each of said first and second ends respectively;

said first guidewall being adapted to receive a spool locking means; and said second guidewall being adapted to engage spring biasing means;

said guidewalls being further characterized by bearing surfaces extending axially therefrom and adapted to facilitate ease of rotation of said assembly within said housing;

spool locking means to frictionally engage said spool assembly thereby preventing rotation; and spring biasing means including an extended eye spring assembly adapted to provide relatively constant tension upon said tethering means;

whereby the tethering means can be simply extended and retracted from said housing and reliably locked in any position.

2. The boat tethering device as set forth in claim 1, wherein said lower half is formed with integral mounting apertures suitable for facilitating attachment to a boat or a dock.

3. The boat tethering device as set forth in claim 1, wherein said lower half is formed with an integral slot for extension and retraction of the tethering means and further contains a thermoplastic wiper wherein added tension is produced and an improved winding pattern is realized.

4. The boat tethering device as set forth in claim 1 wherein said upper half sealably engages said lower half.

5. The boat tethering device as set forth in claim 1 wherein the spool assembly is further characterized by a hollow and generally-cylindrical portion.

6. The boat tethering device as set forth in claim 1 wherein said spool assembly has an outer region which defines an external tether supporting surface; and said spool assembly has an inner region which is delineated by an inner conical zone formed with spaced ribs along the circumference thereof, the diameter of said zone decreasing in an axial direction from said first end to said second end.

7. The boat tethering device as set forth in claim 1 wherein said spool locking means is characterized by having a cylindrical member adapted to frictionally engage the inner conical zone of said spool assembly and having corresponding ribs spaced along the outer circumference of said member, whereby upon insertion within said zone, the corresponding ribs interlock with the ribs of said zone and with integral grooves in said housing thereby preventing rotation.

8. The boat tethering device as set forth in claim 1 wherein the housing is further adapted to include thrust bearings which aid in maintaining the positioning of the spool assembly during operation thereof.

9. A boat tethering device comprising:

extensible tethering means;

a housing having a lower half and an upper half and adapted to contain a spool assembly;

said lower half being formed with integral mounting apertures suitable for facilitating attachment to a boat or a dock;

said upper half sealably engaging said lower half;

the spool assembly characterized by a hollow and generally-cylindrical portion having a first end and a second end and being rotatably mounted within the housing;

said portion having an outer region which provides an external tether supporting surface; and said portion having an inner region which is delineated by an inner conical zone formed with spaced ribs along the circumference thereof, the diameter of said zone decreasing in an axial direction from said first end to said second end;

said assembly being further characterized by first and second opposed guidewalls extending perpendicularly to the axis of said assembly and positioned at each of said first and second ends respectively;

said first guidewall being adapted to receive a spool locking means; and said second guidewall being adapted to engage spring biasing means;

said guidewalls being further characterized by bearing surfaces extending axially therefrom and adapted to facilitate ease of rotation of said assembly within said housing;

spool locking means having a cylindrical member adapted to frictionally engage the inner conical zone of said spool assembly and having corresponding ribs spaced along the outer circumference of said member, whereby upon insertion within said zone, the corresponding ribs interlock with the ribs of said zone and with grooves formed in said housing thereby preventing rotation;

spring biasing means including an extended eye spring assembly adapted to provide relatively constant tension upon said tethering means;

whereby the tethering means can be simply extended and retracted from said housing and reliably locked in any position.

10. The boat tethering device as set forth in claim 9, wherein said lower half is formed with an integral slot for extension and retraction of the tethering means and further contains a thermoplastic wiper wherein added tension is produced and an improved winding pattern is realized.

11. The boat tethering device as set forth in claim 9 wherein the housing is further adapted to include thrust bearings which aid in maintaining the positioning of the spool assembly during operation thereof.

* * * * *